United States Patent [19]

Kroeze et al.

[11] 4,188,861

[45] Feb. 19, 1980

[54] APPARATUS FOR THE CONTINUOUS STACKING OF PAPERBOARD BLANKS

[75] Inventors: Hendrik J. Kroeze, Albergen; Johan H. Hemel, Almelo, both of Netherlands

[73] Assignee: Koppers Company, Inc., Pittsburgh, Pa.

[21] Appl. No.: 869,680

[22] Filed: Jan. 16, 1978

[51] Int. Cl.[2] ..... B31B 1/98

[52] U.S. Cl. ..... 93/93 C; 271/183

[58] Field of Search ..... 93/93 C, 93 DP, 93 R; 271/183, 182, 229

[56] References Cited

U.S. PATENT DOCUMENTS

| | | | |
|---|---|---|---|
| 2,919,789 | 1/1960 | Coakley | 271/183 X |
| 3,596,575 | 8/1971 | Brockmuller | 271/183 X |
| 3,772,971 | 11/1973 | Dutro et al. | 93/93 C |
| 3,938,674 | 2/1976 | Kroeze et al. | 271/201 X |

*Primary Examiner*—James F. Coan

*Attorney, Agent, or Firm*—Thomas L. Sivak; Oscar B. Brumback

[57] ABSTRACT

Disclosed is an apparatus for the continuous stacking of paperboard blanks issuing from a continuously running corrugator capable of producing orders of blanks of different sizes. The stacking apparatus includes a vacuum control box and a variable speed endless conveyor belt which is adapted to speed up and create a gap between the blanks of various sizes. In operation the gap provided allows the blanks of one size to be stacked without interrupting the continuous running of the corrugator.

2 Claims, 1 Drawing Figure

APPARATUS FOR THE CONTINUOUS STACKING OF PAPERBOARD BLANKS

BACKGROUND OF THE INVENTION

1. Field of the Invention

This invention relates to method and apparatus for stacking sheets of material and, more particularly, to a method and apparatus for the continuous stacking of paperboard blanks issuing from a corrugator where one order of blanks following another may be of a different size.

2. Description of the Prior Art

A corrugator produces an endless stream of sheets or blanks. The blanks issuing from one order to another may be of different sizes. This continuous flow of blanks has to be received and stacked. For this purpose there exists fully automatic stacking machines on which stacks are formed and indirectly carried off. The biggest drawback of most prior art stacking machines is that the stack of blanks is not perfectly formed. This creates a great deal of difficulty when the stacks of blanks are to be stored side by side. In most prior art machines the problem arises from the way the blanks are held on the machine while a preceding stack of blanks is being removed, or a last stack of blanks of a particular size is being formed prior to removal. These prior art machines included a gate which extends across the machine and keeps the stream of blanks from advanceing while a stack is being removed or formed. It is the accumulation of blanks in front of the gate that provides the opportunity for misalignment.

The method and apparatus for stacking described and claimed in U.S. Pat. No. 3,938,674 issued Feb. 17, 1976, corrected the problem of misalignment when it was caused by the temporary accumulation of blanks. This prior art stacking machine, however, cannot accept continuous order of blanks of different sizes from a continuous running corrugator. If the apparatus of U.S. Pat. No. 3,938,674 were used when the size of one order were different from the preceding one, the second order would interfere with the last blanks of the first order.

Accordingly, it is an object of the present invention to provide a method and apparatus which can be used to stack different sized orders of boards continuously.

SUMMARY OF THE INVENTION

The present invention overcomes the foregoing problems of the prior art by providing shingling conveyor assemblies adapted to receive blanks from the sandwich conveyors of the cut-off knives of a continuous corrugator. The shingling conveyor assembly of the present invention includes an endless-belt upper first shingling conveyor and a second shingling conveyor which acts as an extention thereof to the stacking platform. The shingling conveyors are driven by motors which are regulated by tachometer-generators so that the conveyors run at a speed less than that of the corrugator. Operably situated between the belts of the sandwich conveyor and the first shingling conveyor is a vacuum control box. The input end of the shingling conveyor assembly is provided with brushes which extend across the width of the assembly to control the deceleration of blanks issuing from the sandwich conveyors.

Photoelectric cells and attendant circuitry are placed in operable relationship with the controls of the cut-off knives of the corrugator so that when predetermined last number of blanks of a particular size order are cut, the first conveyor of each assembly is accelerated. The photocells and circuitry also control the operation of the vacuum control box. After the last blank from the old order passes onto the first shingling conveyor, the vacuum control box control valve is activated. The vacuum control box and the brushes cooperate to retard the flow of the first of the new order blanks over the first shingling conveyor of the assembly. The first shingling conveyor, which has been accelerated, delivers the old blanks at a relatively rapid speed to the second shingling conveyor for transmittal to the stacking platform. The stacking platform is adapted to lower as it receives blanks to maintain a constant fall height for the blanks. The stacker rises to its uppermost position when the blanks are removed. Meanwhile, the new order blanks are accumulated by the vacuum control box. The first shingling conveyor is lowered slowly to provide space for the blanks from the sandwich conveyor and to keep a constant fall height for the blanks to help maintain them in alignment while they are being accumulated.

In most instances the last number of old blanks will be transported to the stacker and removed prior to the time the first shingling conveyor reaches its lowermost position. Once the blanks have been removed from the stacker, electric signal means release the vacuum of the control box which causes the first shingling conveyor to return to normal operation. The new order of blanks are then delivered, as the old order, to the stacker.

In the event the first shingling conveyor reaches its lowermost position prior to the completion of the stacking of the old order blanks, a switch is activated which releases the vacuum of the control box and returns the conveyor to its normal operating speed. The switch also activates the gate assembly at the downstream end of the second shingling conveyor. The gap caused by the accumulation of the new order at the vacuum control box permits the old order to reach the stacker in advance of the new order. When the gate assembly is closed by reason of the first shingling conveyor reaching its lowermost position, a second switch after a preset interval stops the second shingling conveyor. In the event some old order blanks are trapped by the gate on the second shingling conveyor when the gate assembly closes, the gate assembly includes an upper roll that cooperates with a lower roller which is activated by the closing of the gate assembly. The driven lower roll causes any old order blanks trapped between the upper roller of the gate assembly to be delivered to the stacker. After the entire old order is deposited on the stacker, it is removed and it raises to its uppermost position. When the stacker releases its uppermost position, a switch is activated which releases the gate assembly and reactivates the second shingling conveyor. The second conveyor, which is also adapted to lower slowly when stopped to receive blanks from the first shingling conveyor, it also raised to its normal operating position and the blanks from the new order are now transported to the stacker platform.

If the corrugator has upper and low cut-off knives, a lower shingling conveyor assembly is provided. The lower assembly is adapted to receive blanks discharged from the lower cut-off knife. The lower assembly is driven and controlled by separate motors and switches but also provides for the continuous stacking of the blanks as heretofore described.

The present invention provides for the continuous stacking of blank order of various sizes without interrupting the operation of the corrugator.

Description of the Preferred Embodiment

Figure 1:
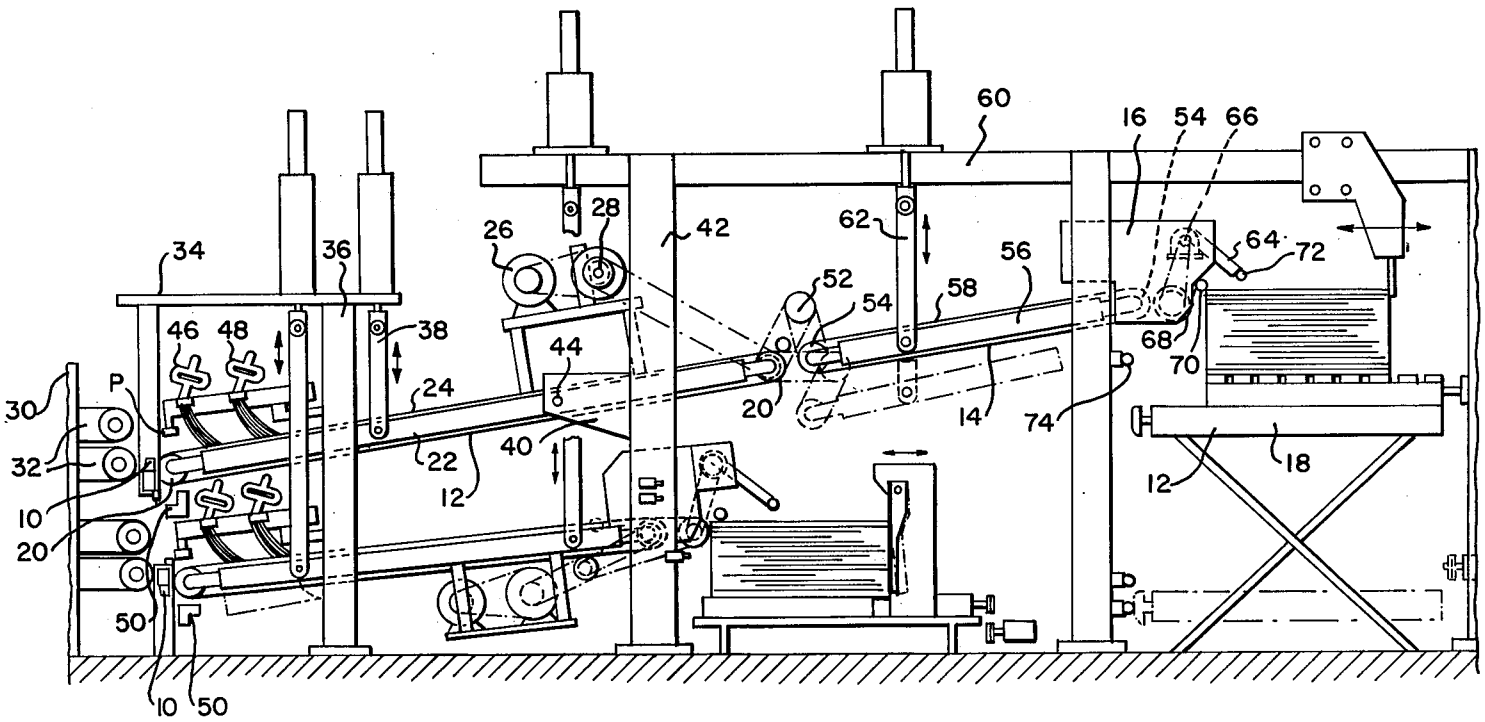
FIG. 1 is a side elevation view of the present invention showing the sandwich conveyor at the supply end of the corrugator.

Referring to FIG. 1, the stacking apparatus of the present invention comprise a vacuum control means 10, a first shingling conveyor 12, second shingling conveyor 14, a gate means 16, and a stacker platform 18. First shingling conveyor 12 consists of a plurality of pulleys 20 supported by a conventional conveyor support table 22. Pulleys 20 support and carry belt 24 which is driven by adjustable speed electric motor 26 through a conventional chain drive 28. The speed of motor 26, and therefore the speed of belt 24, is controlled by means of standard tachometer-generator, not shown, driven by the corrugator 30. During normal operation, the speed of belt 24 is approximately 30% of the speed of the corrugator. As a result, the blanks deposited on conveyor 12 from corrugator 30 through sandwich conveyors 32 are shingled. The tachometer-generator is adapted to increase or decrease of the speed of motor 26 in conjunction with a corresponding change of speed of the corrugator. Corrugator 30 also has conventional cut-off knives, not shown. Operably connected to the cut-off knives is a conventional photoelectric cell, not shown, which is adapted to detect when the last 50 blanks of a particular order have been cut. The photoelectric cell is operably connected by conventional means to the tachometer-generator so when the last 50 blanks have been cut the photoelectric cell signals the tachometer-generator to cause motor 26 to accelerate and increase the speed of belt 24. Under normal conditions, when the signal is received, belt 24 may increase in speed 50%.

Interposed between sandwich conveyor 32 and conveyor 12 is vacuum control means 10 which is as wide as conveyor 32 and conveyors 12 and 14. Vacuum means 10 is evacuated by conventional pump means, not shown, to provide a negative pressure therein. The pump to create the negative pressure is electrically controlled and is adapted to be activated by a photoelectric cell P when the last 50 blanks of the old order which have already been cut pass cell P. Vacuum means 10 is mounted to conveyor 12, which is fixed to frame 36, in order to move down and up with conveyor 12. Biasing means 38 are also fixed to member 34 and conveyor 12 by conventional methods. Biasing means such as hydraulic cylinders 38 permit conveyor 12 to lower when a plurality of blanks is being temporarily stored on it because of the negative pressure from vacuum control 10 which retarded the movement of the blanks. Conveyor 12 is pivotably mounted to flange 40 of frame 42 by means of pivot pin 44. Brushes 46 and 48 are mounted above conveyor 12 in a conventional manner to stabilize the blanks coming from the sandwich conveyors 32 to shingling conveyor 12. Mounted below conveyor 12 is switch 50. When conveyor 12 reaches the lowermost position allowed by biasing means 38, switch 50 is operably connected to vacuum means 10 to release the negative pressure therein. Switch 50 is also operatively connected by means known in the art to close gate assembly 16 when the vacuum is released. When the signal is received, arm 64 pivots through pin 66 to contact driven roll 68. Roll 68 is driven by conventional means not shown. When arm 64 moves past switch 70, electric clutch 52 is disengaged on signal from photoelectric switch 70 and conveyor 14 is stopped. Gate 16 is fixed to frame 60 by conventional means such as bolts.

When clutch means 52 is disengaged, the blanks which were retarded by vacuum means 10 are carried over conveyor 12 to conveyor 14 and permitted to accumulate. Conveyor 14, which is driven by motor 26 and chain drive 28 through clutch 52, consists of pulley 54 supported by table 56 and conveyor belt 58. Conveyor 14 is mounted to frame 60 through hydraulic cylinder 62. When the blanks are being accumulated on conveyor 14, cylinder 62 allows conveyor 14 to lower to accommodate the blanks.

The cooperation of roll 72 on arm 64 and driven roll 68 cause any of the last 50 blanks cut which remain on conveyor 14 to be carried to stacker table 18. Stacker table 18 is adapted to be lowered as blanks are deposited on it. Once all the old order blanks are on table 18, they are removed from the table by means of driven rollers, now shown. When table 18 rises to its uppermost height, it activates switch 74 which is electrically connected by conventional means to gate 16 and clutch 52. Switch 74 engages clutch 52 to start conveyor 14 and opens gate 16 through a conventional aircylinder, not shown. The new order of blanks which have been accumulating on conveyor 14 are free to be stacked on table 18. The apparatus then operates in its normal manner unitl there is another order change and the cycle herein described is repeated. The normal operation without order changes of different length blanks is described in U.S. Pat. No. 3,938,674.

If the corrugator 30 has upper and lower cut-off knives as shown in FIG. 1, the lower shingling conveyor assembly is provided. The lower assembly is driven by separate motors and switches but is similar to the upper assembly described, and in FIG. 1 like parts bear like numbers.

While a certain preferred embodiment of the invention has been described, it will be understood that the invention may otherwise be embodied within the scope of the following claims.

What is claimed is:

1. In an apparatus for continuous stacking of paperboard blanks issuing from a continuously running corrugator, including counter means for counting the number of blanks issuing from said corrugator a first shingling conveyor adapted to receive said blanks from (each of the) sandwich conveyors (cut-off knives) of said corrugator, means for lowering said first shingling conveyor to maintain near constant fall height for said blanks issuing onto said first conveyor, second shingling conveyor means adapted to receive said blanks from said first conveyor and gate means operably positioned with respect to said second conveyor adapted to retard the flow of said blanks from said second conveyor to stacking means adapted to receive said blanks from said second conveyor, said stacking means adapted to raise and lower to maintain a constant fall height for said blanks, the improvement comprising:

(a) control means operably positioned between said sandwich conveyors (cut-off knives) of said corrugator and said first shingling conveyor, said control means adapted to retard the flow of said blanks onto said first shingling conveyor upon a preset signal, (from said counter means,)

(b) switch means adapted to be operably engaged when said first conveyor means reaches its lowermost height for accepting blanks from said sandwich conveyors of the corrugator, said switch means adapted to activate said gate means to retard the flow of any blanks on said second conveyor means, (c) relief means for deactivating said control means, said relief means adapted to be operably engaged when said first conveyor means reaches its lowermost height for accepting blanks from said corrugators, (d) second switch means operably connected to said second conveyor means for deactivating said second conveyor means, said second switch means adapted to be activated when said gate means is activated; and (e) third switch means operably connected to said second conveyor means and said gate means, said third switch means adapted to activate said second conveyor and deactivate said gate means when said stacking means is in its uppermost position.

2. The apparatus of claim 1 wherein said control means is a vacuum means for applying sub-atmospheric pressure to the underside of said blanks issuing from said corrugator, said vacuum means including a plurality of vacuum cups extending substantially the width of said first conveyor means, means for creating said sub-atmospheric pressure in response to said signal from said counter means and switch means for deactivating said vacuum means.

* * * * *